United States Patent [19]

Offergeld et al.

[11] 4,082,498

[45] Apr. 4, 1978

[54] SYSTEM FOR DRYING AND HEATING PARTICULATE COAL

[75] Inventors: Egon Offergeld, Krefeld-Verberg; Martin Wischniewski, Krefeld-Uerdingen, both of Germany

[73] Assignee: Buttner-Schilde-Haas Aktiengesellschaft, Krefeld, Germany

[21] Appl. No.: 665,380

[22] Filed: Mar. 10, 1976

[30] Foreign Application Priority Data

Mar. 12, 1975 Germany ..... 2510737

[51] Int. Cl.[2] ..... F27B 15/00; F26B 3/08; F26B 3/10

[52] U.S. Cl. ..... 432/14; 34/10; 34/57 R; 432/58

[58] Field of Search ..... 34/10, 57 R, 57 A, 57 E; 432/14, 15, 58

[56] References Cited

U.S. PATENT DOCUMENTS

| | | | |
|---|---|---|---|
| 3,282,577 | 11/1966 | Cottle | 432/58 |
| 3,766,661 | 10/1973 | Bayens et al. | 34/10 |
| 3,862,294 | 1/1975 | Engelhart et al. | 432/14 |
| 3,884,620 | 5/1975 | Rammler | 432/15 |

*Primary Examiner*—John J. Camby
*Attorney, Agent, or Firm*—Michael J. Striker

[57] ABSTRACT

Wet particulate coal and a current of hot dry gas at superatmospheric pressure are introduced into a substantially closed drying chamber to contact the material with the gas while maintaining the drying chamber under superatmospheric pressure so that the material is dried by the gas. The dried material is withdrawn from the drying chamber and the gas is withdrawn from the drying chamber and itself mixed with a stream of hot dry gas produced by burning a combustible and a combustion-supporting gas. This mixture is then reintroduced into the drying chamber as the current of hot gas used to dry the coal. The burner is operated at superatmospheric pressure and is formed of a jet-pump type injector, and a diffusor is provided downstream of this injector in the circulation path.

10 Claims, 2 Drawing Figures

SYSTEM FOR DRYING AND HEATING PARTICULATE COAL

BACKGROUND OF THE INVENTION

The present invention relates to a method of an apparatus for heating and drying a particulate material. More particularly this invention concerns the drying and heating of coal.

A system is known wherein gas is circulated around in a closed circulation path at a superatmospheric pressure. Coal or other particulate material to be dried is introduced into this path at one location and withdrawn downstream therefrom, contacting the gas between these locations and being dried thereby. A burner feeds fresh hot and dry gas into this system in order that the coal is dried. Such arrangements are maintained under superatmospheric pressure in order to prevent oxygen-containing gas from entering the path and combustibly or even explosively combining with the hot coal therein.

Such systems comprise, therefore, two blowers in order to maintain the superatmospheric pressure throughout. Not only does the provision of these two blowers result in elevated system costs, but the running costs are also increased thereby.

SUMMARY OF THE INVENTION

It is therefore an object of the present invention to provide an improved method of and apparatus for drying particulate material.

Another object of the provision of such a system which is considerably less expensive both to set up and run than the above-described system.

These objects are attained according to the present invention in a system for drying and heating coal which comprises a generally closed circulation path, a blower for circulating a gas under superatmospheric pressure around the path, means for introducing coal into a mixing location in the path and for withdrawing this coal therefrom after contacting the gas, a burner for producing a hot dry gas, and an injector and a diffusor. The injector has a first inlet connected to the path downstream of the location, a second inlet connected to the burner for receiving hot dry gas therefrom, and an outlet connected through the diffusor to the path upstream of the location. Thus, with this system in the injector, which is a simple jet-pump type of burner, the recirculated gas is mixed at the same pressure with the gases from the burner. The diffusor converts the energy of the quickmoving gas stream produced at the burner into a pressure. The single blower in the system operates such that it creates a slight superatmospheric pressure at the injector. Thus it is possible to use a very simple single blower which runs at a relatively low rate so that construction and operation costs are reduced to a minimum.

Thus, in accordance with the present invention the wet material and a current of hot dry gas at superatmospheric pressure are introduced into a substantially closed drying chamber similarly maintained at a superatmospheric pressure and wherein the material is contacted with the gas so that it is dried. Thereafter, the dried material is withdrawn from the drying chamber. The gas is similarly withdrawn from this drying chamber and is mixed with a stream of hot dry gas produced by burning a combustible and a combustion-supporting gas. This mixture is recirculated back to the drying chamber at superatmospheric pressure and constitutes the current of hot dry gas used to dry the wet material.

According to other features of this invention the burner operates at superatmospheric pressure. To this end both the combustion-supporting gas and the combustible are fed to it at superatmospheric pressure and the combustion takes place at such a rate that the combustion chamber of the injector remains always at superatmospheric pressure. Since the energy of the moving stream of gas produced by the burner is transformed into pressure in the diffusor the burner can be considered to be a blower.

The cooling effect of the nozzle tube of the injector in accordance with this invention is increased by feeding the recirculated gas into this injector tangentially and/or over guide vanes. Thus it is possible to operate the burner at an extremely high temperature so that a relatively large quantity of oxygen-poor recirculated gas is used with a relatively small quantity of burner gas. Consequently, a substantial saving in fuel cost is achieved. Furthermore, with a high burner temperature the oxygen content of the gases in the system is reduced to a minimum which, along with the high steam content in the gas, greatly reduces the explosion potential of the system.

According to another feature of this invention a part of the gas stream from the burner is diverted and passed through a heater which receives particulate material from a cyclone in the main path and located downstream of the drier therein. The output of this heater is fed back into the main circulation path upstream of the blower therein.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
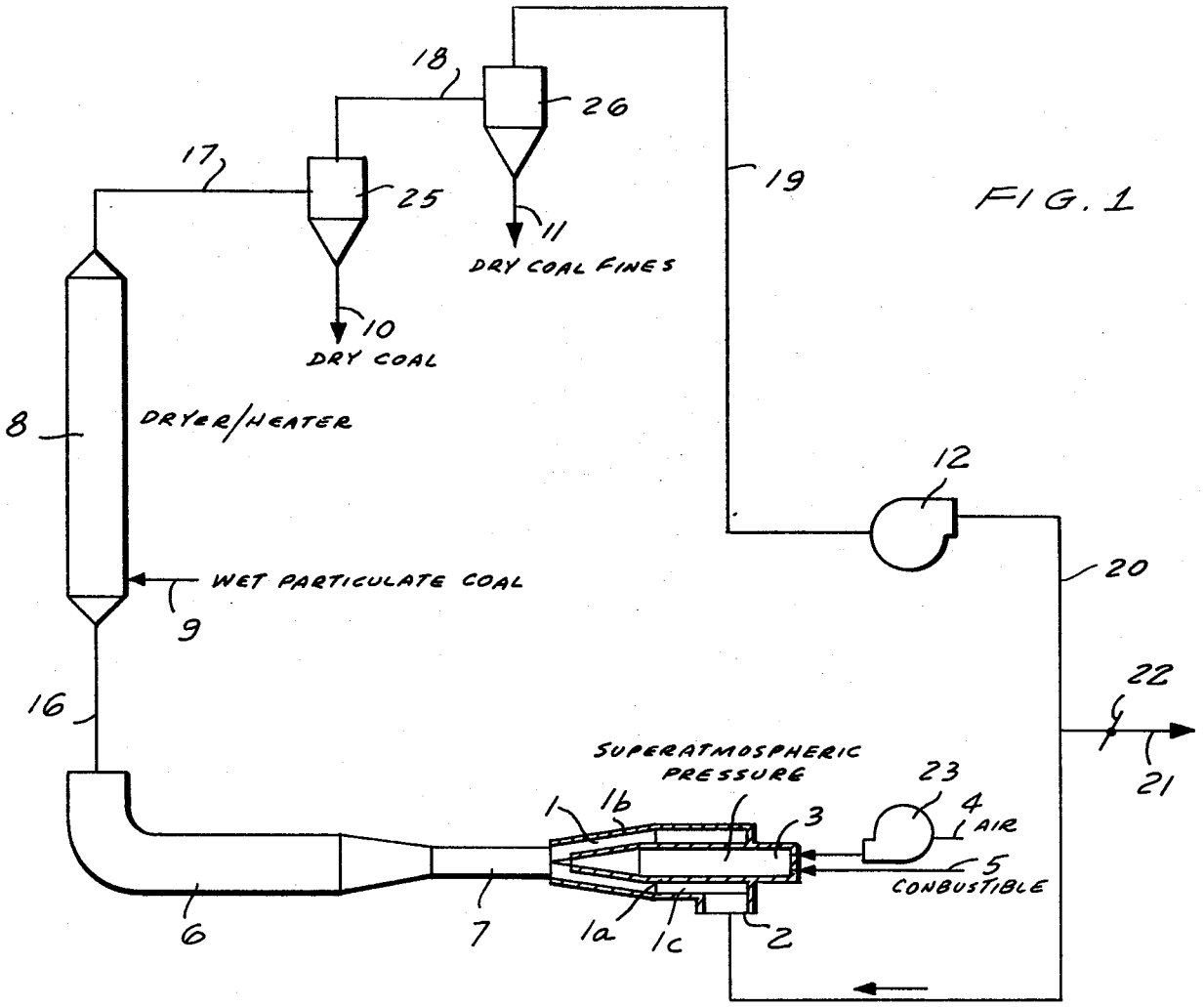
FIG. 1 is a schematic view of a one-stage system according to the present invention.

As shown in FIG. 1 a jet-pump type injector 1 has a laterally opening inlet 2 for receiving recirculated gas and a burner chamber 3 having an air inlet 4 connected to a blower 23 and a combustible or fuel inlet 5. This injector 1 has a tube 1*a* defining with the outer housing 1*b* a chamber in which are provided vanes 1*c* so that the gas entering at 2 contacts this tube and is heated by the hot gases therein.

The outlet of the injector 1 opens into a small-diameter mixing conduit 7 whose outlet in turn opens into a large-diameter diffusor 6. The mixed gas at superatmospheric pressure from the diffusor passes through a conduit 16 into a drier/heater 8 to which wet particulate coal is fed via an inlet 9.

The mixture of coal and gas exits from the drier/heater 8 through a conduit 17 and enters a first cyclone 25 having an outlet 10 from which dry coal is recovered.

Thereafter the remaining gas is fed via conduit 18 to another cyclone 26 having an outlet 11 from which dry coal fines are recovered. Thereafter, the particlefree gas, which is still under superatmospheric pressure, passes via a conduit 19 to a blower 12 whose outlet is connected via a conduit 20 to the inlet 2. A lateral branch 21 from this conduit 20 is provided with an adjustable valve 22 to allow some of this gas in this conduit 20 to be vented to the atmosphere.

The blower 12 is operated so that only a relatively slight superatmospheric pressure is fed to the injector 1.

Figure 2:
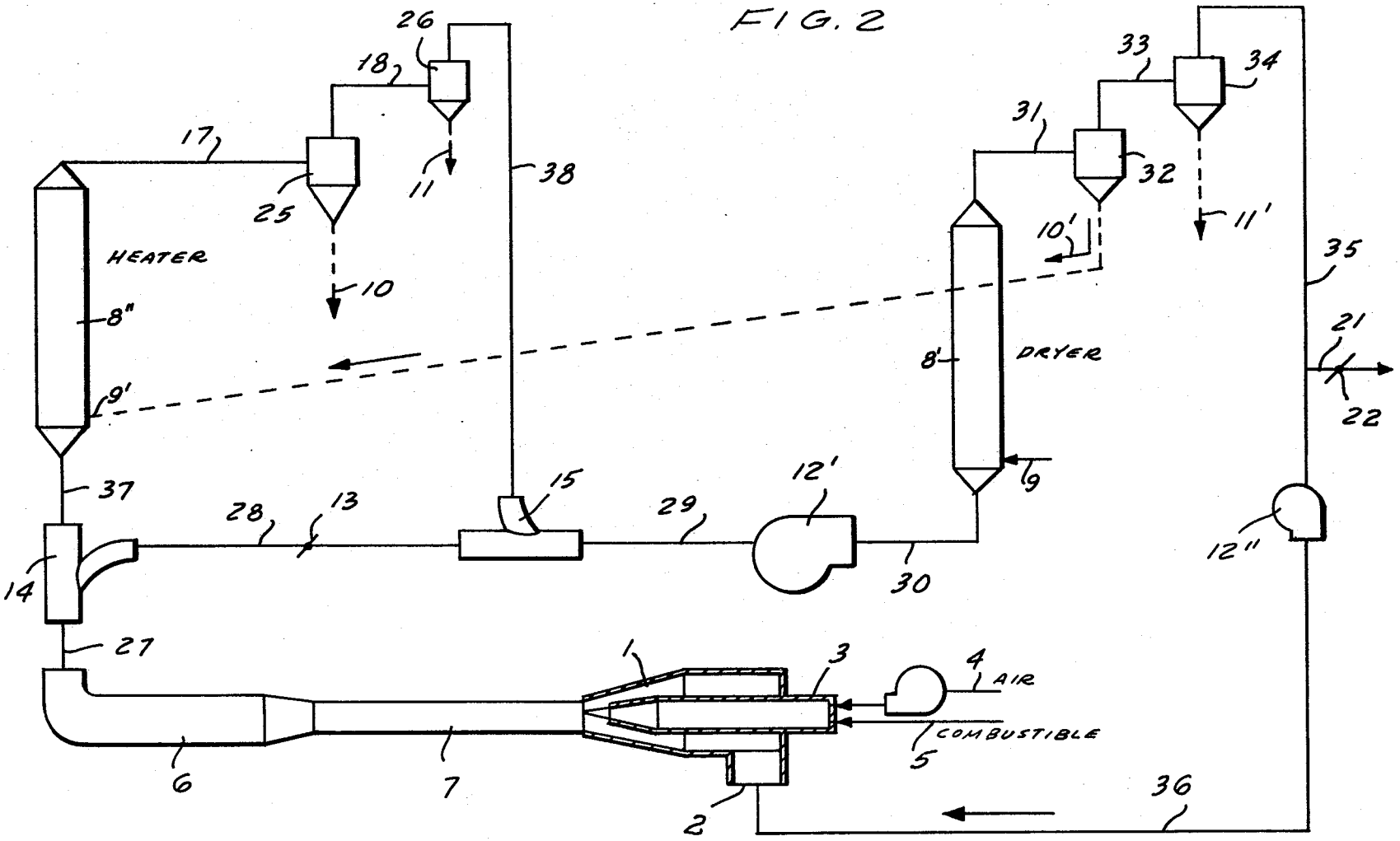
FIG. 2 is a schematic diagram of a two-stage system in accordance with this invention.

In the arrangement of FIG. 2 parts bearing reference numerals identical to those of FIG. 1 identify identical structure. Here the diffusor 6 is connected via conduit 27 to a diverter 14 connected to a conduit 28 provided with an adjustment valve 13 and connected to the input of a further Y-coupling 15 whose outlet side is connected via another conduit 29 to a blower 12' having its outlet connected via conduit 30 to the bottom of a drier 8' having a particulate-coal inlet 9. The outlet of this drier 8' is connected via conduit 31 to a first cyclone 32 having a coarse-coal outlet 10' and connected via another conduit 33 to a further cyclone 34 having a fine-coal outlet 11'. The outlet of this second cyclone 34 is connected via conduit 35 and the blower 12'' to another conduit 36 connected to the lateral inlet 2 of the injector 1.

In addition the other outlet of the Y-coupling 14 is connected via a conduit 37 to the bottom of a heater 8'' having a dry-coal inlet 9' connected to the outlet 10'. The outlet of this heater 8'' is connected to conduit 17 itself connected to cyclone 25 in turn connected to cyclone 26. The outlet of cyclone 26 is connected via conduit 38 to the other inlet of the coupling 15.

The blower 12' therefore passes only gas, the coal that is heated upstream of it in the heater 8'' is removed by the cyclones 25 and 26 so as to protect this blower 12'.

It lies within the scope of this invention to eliminate either of the blowers 12' or 12'' and operate with only one such blower.

It will be understood that each of the elements described above, or two or more together, may also find a useful application in other types of systems differing from the types described above.

While the invention has been illustrated and described as embodied in a system for drying and heating coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A system for drying and heating coal, said system comprising in combination:

conduit means forming a generally closed circulation path having a drying station and a mixing station;

blower means in said path for circulating a drying gas under superatmospheric pressure around said path;

means for introducing said coal into said drying station in said path and for withdrawing said coal therefrom after contacting said drying gas, whereby said coal is dried by said drying gas;

burner means for burning a combustion-supporting gas and a combustible at superatmospheric pressure and thereby producing a hot dry combustion gas under superatmospheric pressure;

injector means at said mixing station having a first inlet connected to said path downstream of said drying station, a second inlet connected to said burner means and receiving said combustion gas therefrom, and an outlet for mixing said drying gas circulating in said path with said hot dry combustion gas of said burner means at said mixing station; and a diffuser in said path between said outlet and said drying station.

2. The system defined in claim 1 wherein said injector means is provided with vanes between said first inlet and said outlet.

3. The system defined in claim 1 wherein said first inlet opens tangentially into said injector.

4. The system defined in claim 1, wherein said blower means is a blower in said path downstream of said drying station and upstream of said burner means.

5. The system defined in claim 1; further comprising:

second conduit means defining a second flow path having an upstream end opening into the first-mentioned path at a first location downstream of said burner means and upstream of said drying station, and a downstream end opening into said first path at a second location downstream of said first location and upstream of said drying station, said second path having a second drying station separate from the first-mentioned drying station;

means for forcing a portion of the gas in said first path through said second path from said upstream end to said downstream end thereof and through said second drying station; and means connected to said means for introducing and withdrawing for introducing the dried coal into said second drying station and for withdrawing said dried coal therefrom after contacting the gas therein.

6. The system defined in claim 5, wherein said means for forcing includes a valve forming a variable restriction in said first path downstream of said first location and upstream of said second location.

7. A method of drying wet particulate material, said method comprising the steps of:

(a) continuously circulating a drying gas in a substantially closed flow path past a drying station and a mixing station;

(b) continuously maintaining said drying gas under superatmospheric pressure in all of said path;

(c) exposing said wet material at said drying station to said drying gas to dry said material;

(d) withdrawing the dried material from said path;

(e) burning a combustible and a combustion-supporting gas under superatmospheric pressure to form a hot dry combustion gas under superatmospheric pressure; and (f) mixing said hot combustion gas with said drying gas at said mixing location under superatmospheric pressure.

8. A method of drying wet particulate material, said method comprising the steps of:

(a) continuously circulating a drying gas in a substantially closed flow path past a drying station and a mixing station;
(b) continuously maintaining said drying gas under superatmospheric pressure in all of said path;
(c) exposing said wet material at said drying station to said drying gas to dry said material;
(d) withdrawing the dried material from said path;
(e) burning a combustible and a combustion-supporting gas under superatmospheric pressure to form a hot dry combustion gas under superatmospheric pressure;
(f) mixing said hot combustion gas with said drying gas at said mixing location under superatmospheric pressure;
(g) withdrawing a portion of the gas in said path from a first location downstream of said mixing station and upstream of said drying station, passing said portion through a second drying station separate from the firstmentioned drying station, and thereafter reintroducing said portion into said path at a second location downstream of said first location and upstream of said drying station; and
(h) exposing at least some of the withdrawn dried material of step (d) to said withdrawn gas in said second drying station.

9. The method defined in claim 8; further comprising the step (i) of maintaining said portion constantly under superatmospheric pressure.

10. The method defined in claim 8; further comprising the step (j) of restricting flow in said path between said locations.

* * * * *